US007415956B1

(12) United States Patent
Prior

(10) Patent No.: US 7,415,956 B1
(45) Date of Patent: Aug. 26, 2008

(54) ENGINE AIR INTAKE SYSTEM WITH RESILIENT COUPLING HAVING INTERNAL NOISE ATTENUATION TUNING

(75) Inventor: Gregory P. Prior, Birmingham, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 234 days.

(21) Appl. No.: 11/671,593

(22) Filed: Feb. 6, 2007

(51) Int. Cl.
*F02M 35/10* (2006.01)

(52) U.S. Cl. ..... 123/184.53; 181/247; 285/299

(58) Field of Classification Search ..... 123/184.53, 123/184.57; 181/214, 229, 247; 285/299
See application file for complete search history.

(56) References Cited

U.S. PATENT DOCUMENTS 6,752,240 B1 * 6/2004 Schlagenhaft ..... 181/247

FOREIGN PATENT DOCUMENTS

JP 2005009339 A * 1/2005

* cited by examiner

*Primary Examiner*—Noah Kamen

(57) ABSTRACT

An engine air intake system, which may include a supercharger or other air-handling device, includes a resilient coupling connecting an air intake connector, such as a throttle body, and an air inlet duct. The resilient coupling includes a bellows convolution for allowing limited motion between connected components. The coupling is molded with tuning volumes and connecting passages within the convolution with open sides to allow removal from the mold die. An associated connector closes the chambers upon assembly and forms noise reduction tuning for high frequency air pressure waves.

10 Claims, 7 Drawing Sheets

ENGINE AIR INTAKE SYSTEM WITH RESILIENT COUPLING HAVING INTERNAL NOISE ATTENUATION TUNING

TECHNICAL FIELD

This invention relates to an engine air intake system including internal noise attenuation chambers formed in an inlet coupling.

BACKGROUND OF THE INVENTION

It is often necessary to attenuate high frequency noise in engine induction systems, particularly in those with superchargers. Traditional approaches include quarter wave tuners or Helmholtz tuners. Higher frequency Helmholtz tuners are very small and any significant attenuation requires a number of small tuning volumes. Conventional systems work very well, but they do require volume which occupies valuable space in an engine compartment for a vehicle and adds to the cost if provided by a separate add on device.

SUMMARY OF THE INVENTION

In an exemplary embodiment, the present invention proposes forming a series of quarter wave tuners and/or Helmholtz tuners molded integrally with a resilient air intake coupling or seal of an engine intake system. The device includes molded openings or orifices and baffles or radial walls in a roughly toroidal volume around an airflow passage connected with a throttle body or other inlet passage member near an engine or supercharger intake of an internal combustion engine. A location at the throttle body inlet to a supercharger should be ideal for tuning out high frequency supercharger inlet frequencies of air pulsations. Noise reducing coupling devices could be utilized in other locations with various sizes of tuning volumes and orifices or neck passages. Tuning chambers in a single coupling or seal body could be of identical sizes or varied to tune across a range of frequencies.

These and other features and advantages of the invention will be more fully understood from the following description of certain specific embodiments of the invention taken together with the accompanying drawings.

DESCRIPTION OF AN EXEMPLARY EMBODIMENT

Figure 1:
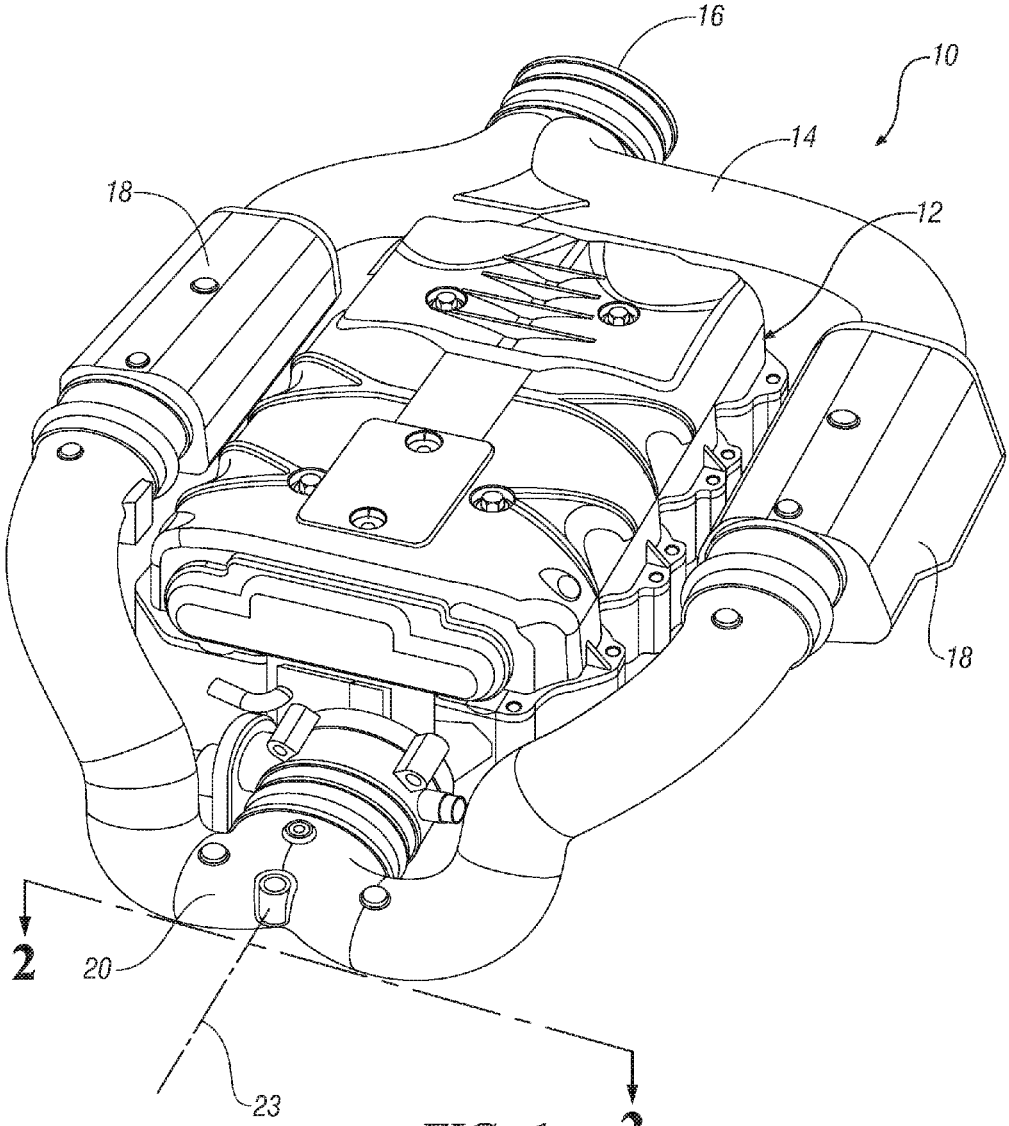
FIG. 1 is a pictorial view of an engine air intake system according to the invention and including a supercharger.

Referring first to FIG. 1 of the drawings in detail, numeral 10 generally indicates a portion of an exemplary embodiment of engine air intake system according to the invention. The illustrated system includes a Roots type supercharger 12, although the system could be used with other types of superchargers or compressors or without a compressor or supercharger mechanism when applied to a naturally aspirated engine. The system as illustrated further includes a dual path air feed duct 14 having an inlet 16 at one end adapted for connection to a source of ambient air, such as a filter, not shown. At other ends, duct 14 connects with a pair of resonators 18 adapted to tune out selected noise frequencies present in the intake system.

Figure 2:
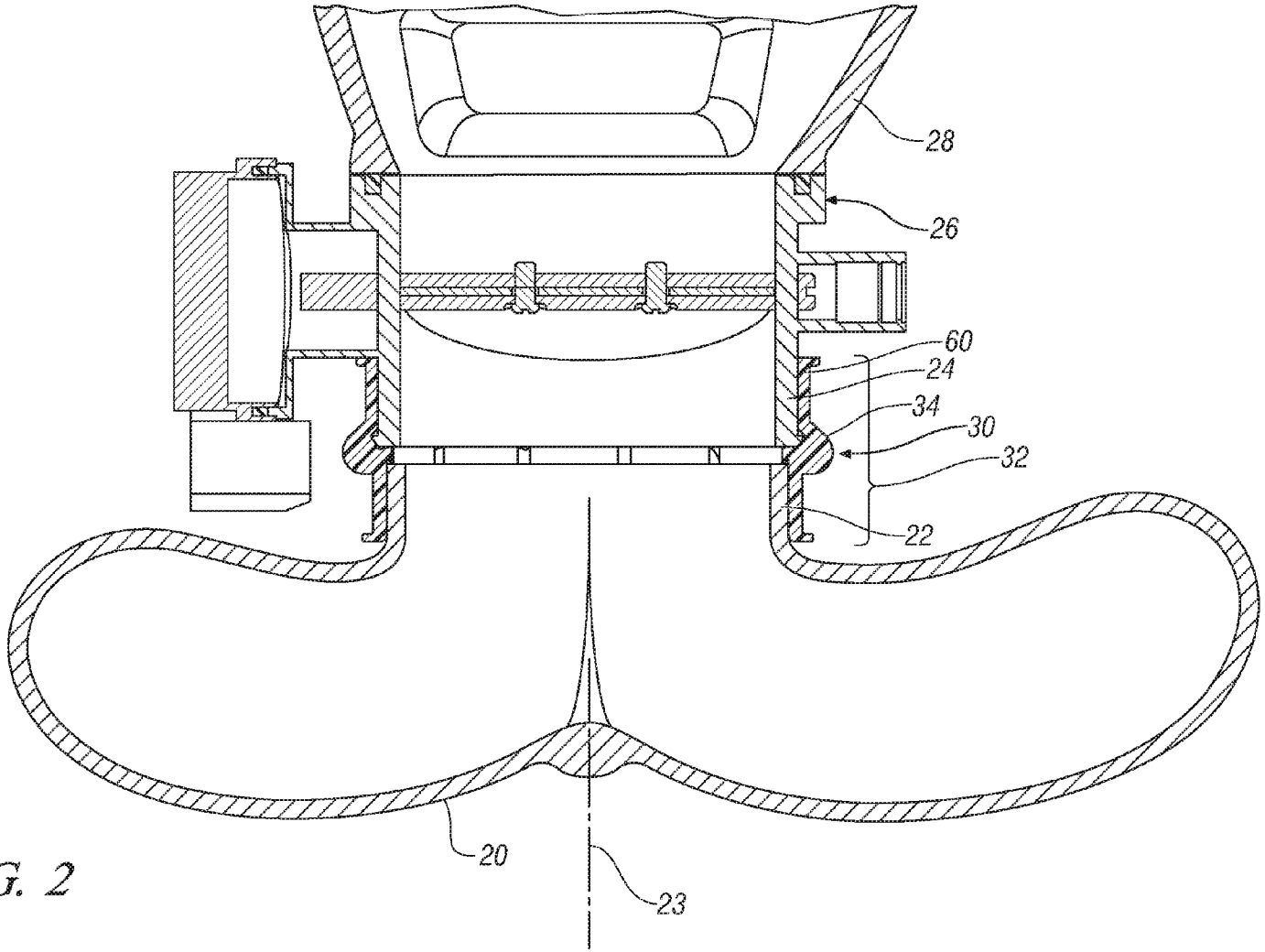
FIG. 2 is a partial cross-sectional view looking downward from the line 2-2 of FIG. 1 and the intersecting inlet duct outlet connector axis.

The resonators 18 in turn connect with an air inlet duct 20 having a tubular outlet connector 22 with an axis 23 as shown in FIGS. 1 and 2. This tubular outlet connector is connected with a throttle body connector 24 formed by the inlet end 24 of a throttle body 26 mounted to an inlet 28 of the supercharger 12. The connection between the inlet duct outlet connector 22 and the throttle body connector 24 is sealed by a resilient coupling or seal 30 formed according to the invention.

The inlet duct outlet connector 22, the throttle body inlet connector 24 and the resilient coupling 30 have a prime function of forming a resilient sealed connection or joint 32 between the air inlet duct 20 and the throttle body 26 which accommodates some relative motion between the parts. For this purpose, the seal or resilient coupling 30, includes a convolution 34 that provides the necessary flexibility together with the resilient material of the seal 30. In accordance with the invention, a generally annular volume or recess 35 within the convolution 34 is utilized to form tuning chambers. The tuning chambers, to be subsequently described, are capable of tuning out higher frequency noise pulsations in the intake air using the space provided in the annular recess 35 within the convolution 34 as modified in accordance with the invention.

Figure 3:
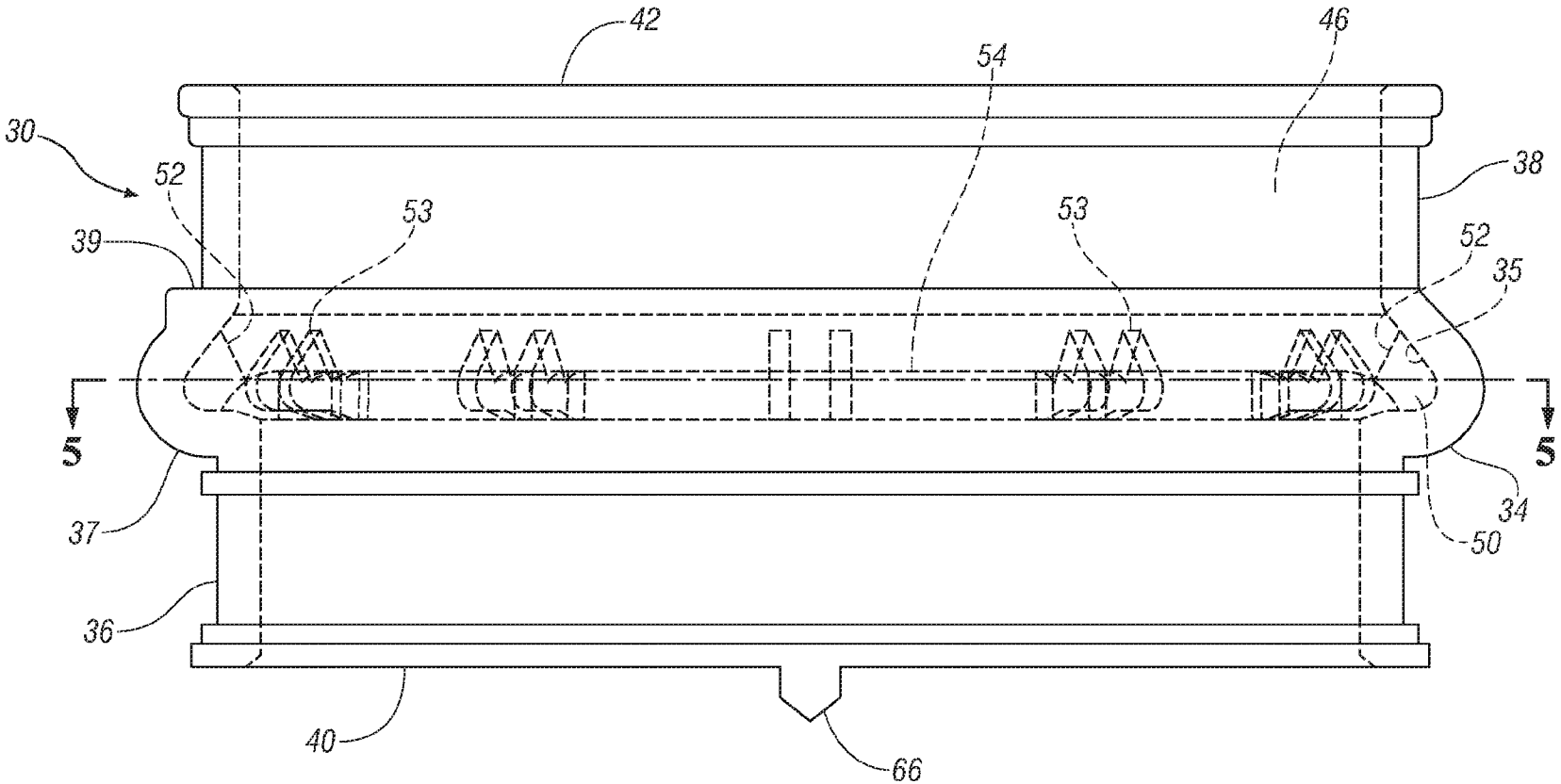
FIG. 3 is a side view of a one-piece resilient coupling including tuning volumes according to the invention.
Figure 4:
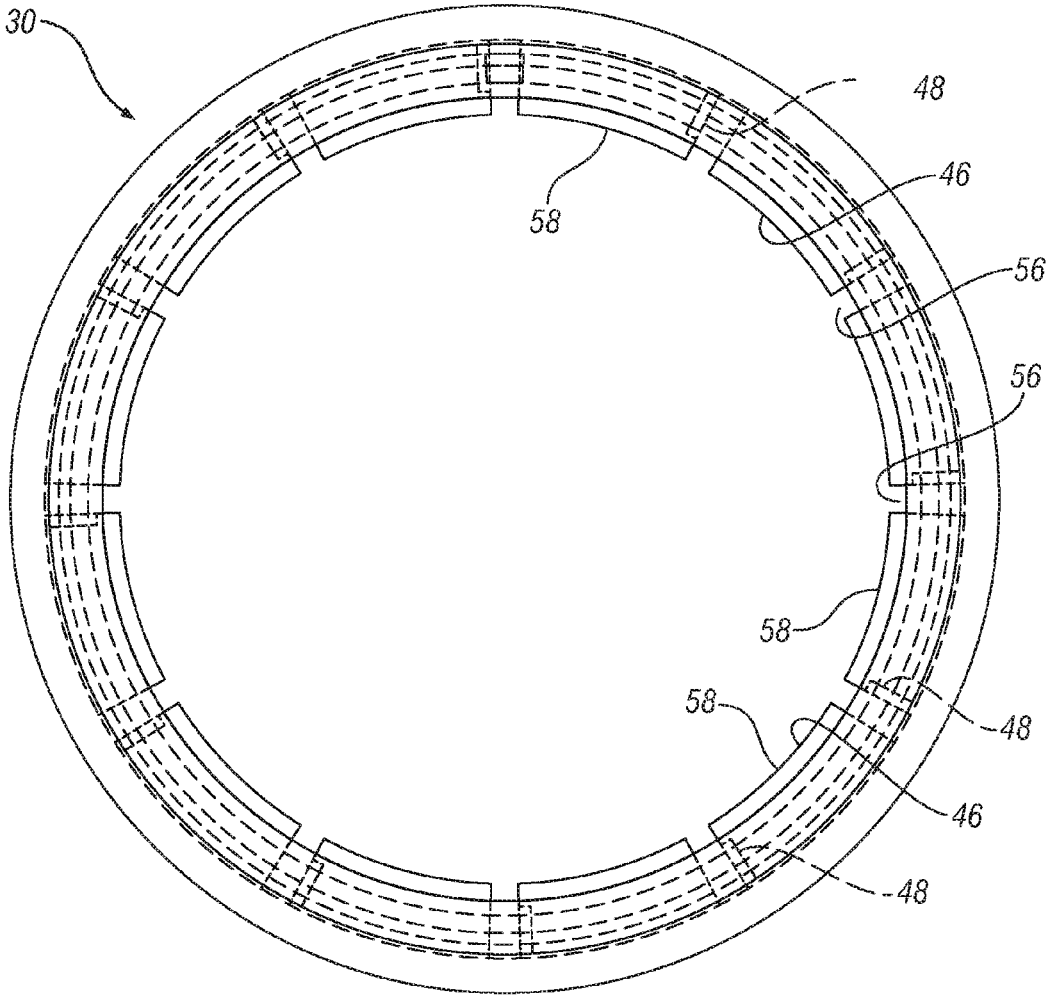
FIG. 4 is an inlet end view of the coupling of FIG. 3.
Figure 5:
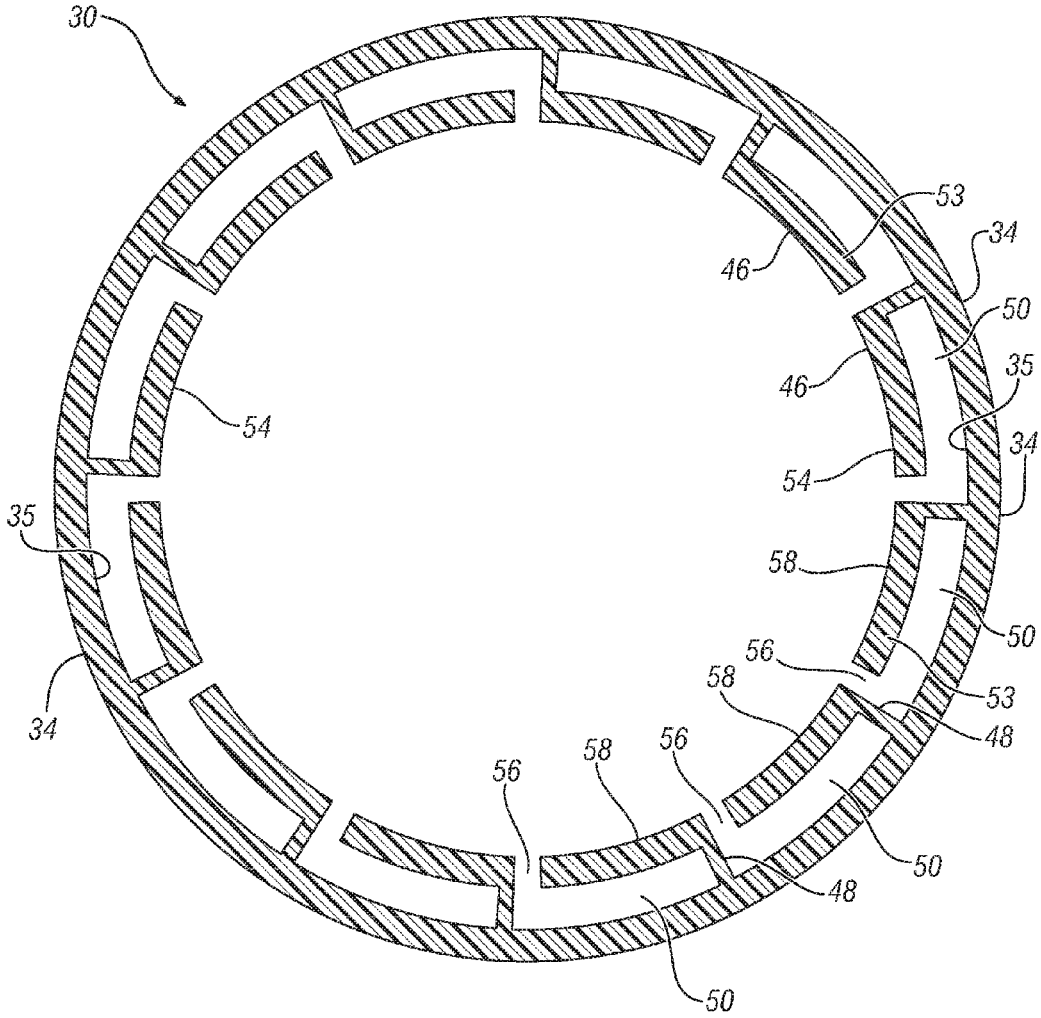
FIG. 5 is a cross-sectional view toward the inlet end from the line 5-5 of FIG. 3 showing the tuning chambers in the resilient coupling convolution.

Referring now to FIGS. 3-5, the construction of the resilient coupling or seal 30 is as follows. The seal/coupling is molded of a non-porous resilient material capable of being deformed sufficiently to remove it from the mold used in its manufacture. The coupling 30 is formed as a unitary body having an enlarged intermediate portion forming the convolution 34. A tubular flange 36 in the form of a clamp flange extends axially from an inlet end 37 of the convolution 32. A second tubular flange 38, also a clamp flange, extends axially from the opposite outlet end 39 of the convolution 34. Both flanges 36, 38 include outer end rims 40, 42 which stiffen the clamp flanges and assist in retaining clamps in assembly.

Between the first and second flanges 36, 38, the enlarged intermediate portion or convolution 34 appears externally as an annular ring like protrusion. Internally, the convolution defines the generally annular recess 35, which connects inwardly with an axial air passage 46 through the coupling 30. Generally radial walls 48 divide the recess 35 into a plurality of generally arcuate circumferentially spaced chambers or tuning volumes 50. These have inwardly open sides 52 connecting with the axial air passage 46.

Axially adjacent the open sides 52, the chambers 50 have closed inner sides 53 formed by an axially extending annular rim 54 inwardly adjacent the annular recess 35. Radial slots 56 extend through the annular rim 54 to connect one angular end of each of the arcuate chambers 50 with the annular air passage 46. The radial walls 48 close the opposite angular ends of the chambers 50.

The above described unitary or one-piece resilient coupling 30 is internally configured to allow the resilient member to be removed from the mold on which it is manufactured or formed. For this purpose, the annular recess 35 may be angled inwardly, toward the flange 38 at the outlet end of the coupling 30 as shown in the drawings. However, this necessitates leaving of the open inner sides 52 of the chambers 50 at the inner edge of the annular recess 44 and open tops of the slots 56, which prevents completion of the separate tuning volumes of the chambers 50 by formation of the resilient coupling alone.

Figure 6:
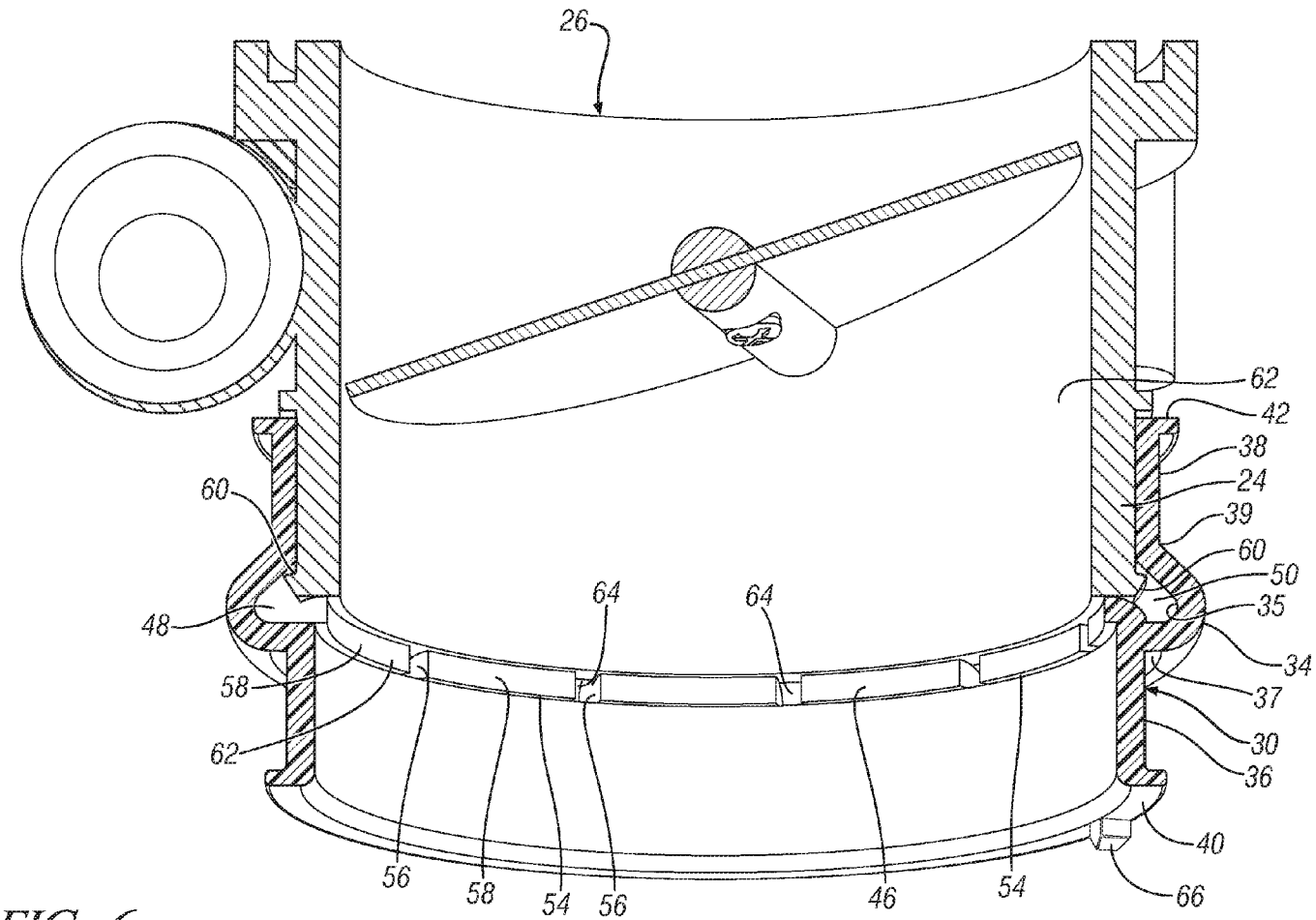
FIG. 6 is a cross-sectional pictorial view showing the throttle body (connector) and resilient coupling assembly with neck passages opening to an internal air passage.
Figure 7:
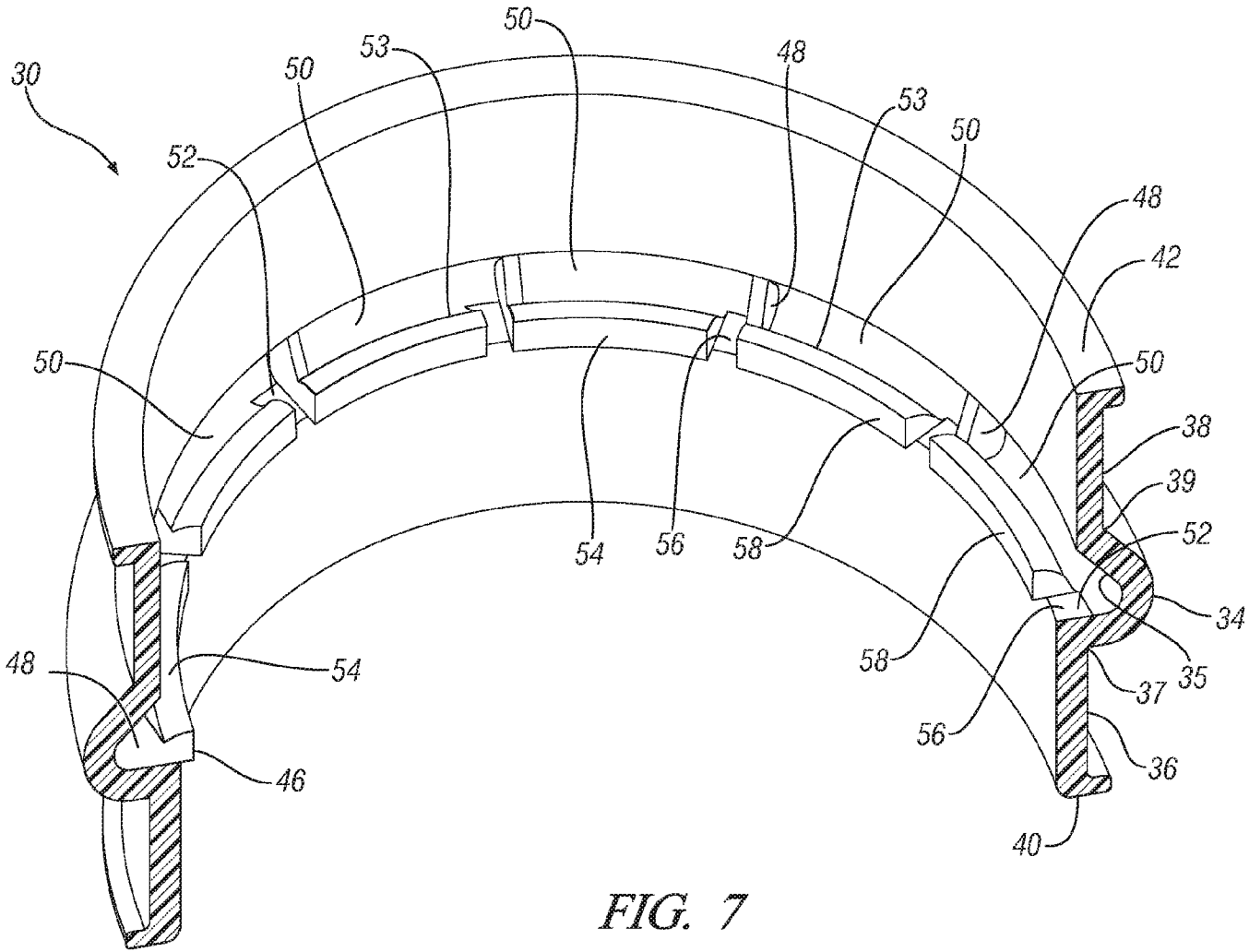
FIG. 7 is a cross-sectional pictorial view of the resilient coupling showing interior open-sided tuning chambers and slots defining neck passages.

Referring to FIGS. 2 and 6, the tuning volumes are then completed by insertion of the throttle body connector 24, formed by the inlet end 24 of the throttle body, into the second tubular flange 38 of the resilient coupling 30. The inlet connector 24 of the throttle body extends into the tubular flange 38 and engages arcuate inner walls 58 of the chambers 50, closing the open sides 52 of the chambers 50 and open ends of the radial slots. A radially protruding annular rim 60 on the end of the throttle body inlet connector 24 extends partially into the recess 35 of the resilient coupling 30 and thereby maintains the throttle body in assembly with the coupling 30. The rim 60 also engages the radial walls 48, maintaining separation of the chambers 50 and closing open sides of the radial slots 56 to form neck passages 62. The resulting closed chambers 50 thus form tuning volumes which, after assembly with the throttle body, communicate with the inner axial air passage 62 of the assembly only through the neck passages 64 which are formed by radial slots 56 in the raised annular rim 54 within the resilient coupling 30.

The volumes of the chambers or tuning volumes 50 and the length and cross sectional area of the neck passages 62 are selected to form Helmholtz resonators capable of tuning out high frequency noise occurring at the inlet to the throttle body, thereby reducing the noise level in the engine air intake connection to the associated supercharger 12 or to the engine itself if a supercharger is not present in the air intake system.

Final assembly of the engine air intake system 10 includes assembling the throttle body 26 to the supercharger 12 and assembling the inlet duct outlet end 22 into the inlet tubular flange 36 of the resilient coupling 30. A locating lug or indicator 66 may be formed on a rim of the clamp flange 38 in order to position the resilient coupling properly with respect to the inlet duct 20.

It should be understood that in other engine arrangements, the connector on the outlet side of the resilient coupling may be formed by any suitable tubular member instead of a throttle body, as the requirements of the installation may determine. This alternative connector could then act to form the tuning volumes by closing off the inner sides of the chambers 50 in the resilient coupling 30.

It should be noted that the arcuate inner walls 58 of the annular rim 56 extend slightly inward of the interior of the second tubular flange 38 and act as a stop, allowing extension of the throttle body into the flange 38 only far enough to close the open upper sides of the chambers or tuning volumes 50 and slots 50. The inner walls (stop) 58 thus prevent further insertion of the throttle body connector, thereby maintaining open the neck passages 64 between the chambers or tuning volumes 50 and the axial air passage 62 of the assembly formed by the resilient coupling 30, the throttle body 26 and the inlet duct outlet connector 22 which is prevented by the stop from covering inner ends of the radial neck passages 64.

Further elements of an engine air intake system not shown but conventional include an intake opening and intake manifolds of an engine not shown connectable with the supercharger 16 or an alternative compressor or blower which may be substituted for the supercharger illustrated. Alternatively, the high frequency tuning resilient coupling 30 could be connected directly to an inlet duct to a naturally aspirated engine without an intervening supercharger or other compressor or blower and could function to reduce high frequency vibrations or pulsations in the engine intake duct to the extent such are present.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. An engine air intake system with internal noise reduction tuning, the system comprising:

a generally tubular resilient coupling including an enlarged intermediate portion forming a generally annular recess connecting inwardly with an axial air passage through the coupling, generally radial walls dividing the recess into a plurality of generally arcuate circumferentially spaced chambers having inwardly open sides, each chamber connected through a neck passage with the axial air passage, and an annular flange extending axially from an end of the intermediate portion; and a tubular connector seemingly received within the annular flange and having an inner end engaging the chambers and closing their open sides to form tuning volumes in the coupling and connected by their neck passages with the axial air passage to provide tuning of selected airflow pressure wave frequencies generated in the system.

2. The invention of claim 1 wherein the tubular connector engages an axially extending annular rim forming inner sides of the chambers adjacent their open sides and the neck passages extend through the annular rim.

3. The invention of claim 2 wherein the neck passages comprise slots in the annular rim.

4. The invention of claim 1 wherein the connector also forms an air inlet throttle body.

5. The invention of claim 1 including a second connector received within a second annular flange on an opposite end of the resilient coupling and a stop in the coupling preventing the second connector from blocking the neck passages from connection with the axial air passage.

6. The invention of claim 5 wherein the second connector is an air intake member.

7. The invention of claim 1 wherein the tuning volumes define Helmholtz tuners.

8. The invention of claim 1 wherein the air intake system is connected with an engine air intake.

9. The invention of claim 8 wherein the air intake system is connected with a compressor connected with the engine air intake.

10. The invention of claim 8 wherein the intake air system is connected with a supercharger connected with the engine air intake.

* * * * *